United States Patent [19]

Nagano et al.

[11] 4,089,737

[45] May 16, 1978

[54] DELIGNIFICATION OF CELLULOSIC MATERIAL WITH AN ALKALINE AQUEOUS MEDIUM CONTAINING OXYGEN DISSOLVED THEREIN

[75] Inventors: Tadashi Nagano, Tokyo; Saisei Miyao; Katsuhiko Takeda, both of Kure, all of Japan

[73] Assignee: Toyo Pulp Company, Ltd., Japan

[21] Appl. No.: 718,935

[22] Filed: Aug. 30, 1976

Related U.S. Application Data

[63] Continuation of Ser. No. 511,474, Oct. 1, 1974, abandoned.

[30] Foreign Application Priority Data

Feb. 18, 1974 Japan ..... 49-19287

[51] Int. Cl.[2] ..... D21C 3/02; D21C 9/00

[52] U.S. Cl. ..... 162/19; 162/38; 162/61; 162/65; 162/90

[58] Field of Search ..... 162/17, 19, 37, 38, 162/39, 52, 61, 65, 90; 8/111

[56] References Cited

U.S. PATENT DOCUMENTS

| | | | |
|---|---|---|---|
| 3,024,158 | 3/1962 | Grangaard et al. | 162/65 X |
| 3,525,665 | 8/1970 | Gessner | 162/19 |
| 3,654,070 | 4/1972 | Pradt et al. | 162/65 X |
| 3,660,225 | 5/1972 | Uerreyne et al. | 162/65 X |
| 3,701,712 | 10/1972 | Samuelson et al. | 162/65 |
| 3,759,783 | 9/1973 | Samuelson et al. | 162/65 X |
| 3,764,464 | 10/1973 | Samuelson | 162/65 |
| 3,832,276 | 8/1974 | Roymoulik et al. | 162/65 |

*Primary Examiner*—Arthur L. Corbin

*Attorney, Agent, or Firm*—Wenderoth, Lind & Ponack

[57] ABSTRACT

Cellulosic material is delignified with oxygen previously dissolved into a fresh alkaline aqueous medium, all of the oxygen contacting said cellulosic material being introduced into said cellulosic material by said alkaline aqueous medium containing oxygen dissolved therein and the cellulosic material consistency during delignification being such as to form an agglomeration of said cellulosic material and alkaline aqueous medium in the form of a layer without any gaseous space therein.

13 Claims, 2 Drawing Figures

Figure 1:
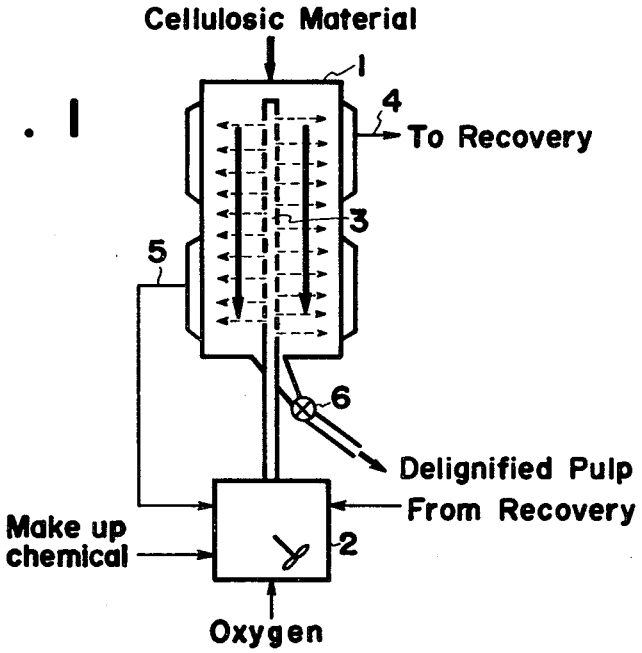

DELIGNIFICATION OF CELLULOSIC MATERIAL WITH AN ALKALINE AQUEOUS MEDIUM CONTAINING OXYGEN DISSOLVED THEREIN

This is a continuation of application Ser. No. 511,474, filed Oct. 1, 1974, now abandoned.

As is generally known, an example of applying oxidative delignification with oxygen in a pulp and paper industry has been oxygen bleaching in which delignification is carried out at a pulp consistency of more than about 18% by weight based on the mixture of pulp and an alkaline aqueous medium, i.e. in the vapor phase. The reason why so high a pulp consistency is necessary is that the solubility degree and the dissolution rate of oxygen into an alkaline aqueous medium are small. For this reason, pulp should be fluffed in a reaction vessel at a high pulp consistency to enlarge the surface are of pulp and to let the alkaline aqueous medium exist around the pulp fiber surface only as a thin layer. By contacting oxygen gas with such fluffed pulp through the thin layer of the alkaline aqueous medium, delignification proceeds effectively.

In such delignification at the high pulp consistency as described above, it is possible, in the case where residual lignin in the pulp is small, to operate the system safely without risk of explosion due to the heat generation during lignin degradation if careful attention is paid to the control of reaction, since the exothermic reaction of lignin degradation by oxygen is not violent in this case. On the other hand, in case of delignification of high yield pulp having high lignin content, there is a big risk of explosion so far as the controlling method is commercial use is applied, due to the great heat generation caused by lignin degradation. It is now essential that some fundamental solutions for this problem be obtained.

On the other hand, many studies have also been done as to oxidative delignification at relatively low pulp consistency, i.e. in the liquid phase. In general, oxidative delignification is considered to be the heterogeneous surface reaction in which lignin degradation proceeds by the contact of cellulosic materials, alkaline aqueous medium and oxygen. Therefore, conditions of their contact and reaction conditions such as reaction temperature, pressure, time and type of alkali used have significant effects upon delignification, especially in case of oxidative delignification in the liquid phase. For this reason, the choice of optimum conditions for delignification is so difficult that oxidative delignification in the liquid phase has never yet been put to complete practical application.

It is therefore an object of the present invention to provide a new method of delignifying cellulosic materials in which disadvantages of prior art methods as described above are overcome and high lignin content pulp and further wood chips, as well as chemical pulp, can effectively be delignified.

It is another object of the present invention to provide a new method of delignifying cellulosic materials in which a risk of explosion due to the heat generation during lignin degradation is substantially eliminated.

It is further object of the present invention to provide a new method of delignifying cellulosic materials in which the contact of cellulosic materials, alkaline aqueous medium and oxygen is effectively made, to conduct effective delignification and to significantly shorten the reaction time.

It is further object of the present invention to provide a new method of delignification of cellulosic materials wherein high quality pulp can be produced.

In accordance with the invention, there is provided, in brief, a method of delignifying cellulosic materials which oxygen in the presence of an alkaline aqueous medium at an elevated temperature in a pressurized reaction vessel which comprises previously dissolving said oxygen into said alkaline aqueous medium, contacting said alkaline medium containing dissolved oxygen with said cellulosic materials in said reaction vessel to conduct oxidative delignification of said cellulosic materials, the consistency of said cellulosic materials being kept so as to form an agglomeration of the cellulosic materials and the alkaline aqueous medium not having any gaseous space therein, discharging a part of or substantial part of the waste liquor, formed during delignification, from the vessel, while supplementarily charging the fresh alkaline aqueous medium containing dissolved oxygen into the vessel, whereby the displacement of the waste liquor with the fresh alkaline aqueous medium containing dissolved oxygen is carried out continuously throughout the delignification.

Figure 2:
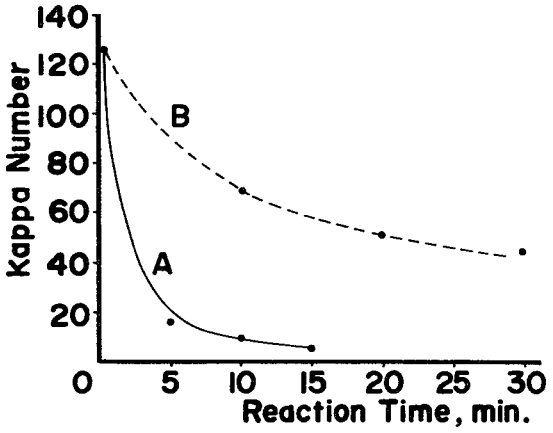

The aforementioned and other objects and features of the invention will be apparent from the following detailed description, when read in conjunction with the accompanying drawings, in which FIG. 1 is a schematic diagram illustrating equipment used in a preferred embodiment of the invention; and FIG. 2 is a graph showing a relationship between reaction times and Kappa numbers of resulting pulp obtained by the present invention and by a conventional method.

We have investigated various methods of oxidative delignification of cellulosic materials with oxygen in liquid phase at comparatively low cellulosic materials consistency of between about 5 to about 20% by weight based on the mixture of cellulosic materials and the alkaline aqueous medium, in order to provide a new and improved method wherein pulp of any lignin content can be delignified and the problem in vapor phase treatment as mentioned above can be solved. As the results of the investigation, following information has been obtained: in the case where cellulosic materials are subject to delignification with oxygen in liquid phase.

1. The oxidative degradation of lignin proceeds very quickly in the alkaline aqueous medium under certain conditions of temperature and pressure, while the dissolution and transfer rate of oxygen gas in the alkaline aqueous medium are low. For this reason, the ambient zone of the reaction is considered to continuously suffer from a "shortage of dissolved oxygen". Due to "oxygen starvation", the reaction to be effected is delayed. Therefore, in order to keep the reaction proceeding rapidly, it is necessary to maintain constant contact between the alkaline aqueous medium containing dissolved oxygen and the cellulosic materials.

2. On the other hand, soluble salts of organic acids which are produced by oxidative degradation of lignin tend to accumulate in the interface between the alkaline aqueous medium and cellulosic materials. This not only decreases the solubility of oxygen into the alkaline medium, but also adversely affects the contactive reaction of oxygen with cellulosic materials due to a type of Donnan's membrane equilibrium. Therefore, it is preferred that such salts of organic acids by-produced be removed from the interface for effective delignification with oxygen.

The present invention is based on the abovementioned discoveries as to delignification of cellulosic materials with oxygen in the alkaline aqueous medium.

According to the present invention, oxygen is previously dissolved into the alkaline aqueous medium and the waste alkaline medium is continuously displaced with fresh medium containing dissolved oxygen, thereby keeping constant contact of the alkaline aqueous medium containing dissolved oxygen with cellulosic materials.

Furthermore, in order to remove salts of organic acids from the interface, in oxygen dissolved alkaline medium is passed through the pulp or chips suspension, mat, layer or the like to thereby break down the so-called Donnan's membrane equilibrium.

The consistency of cellulosic materials to be employed in the present invention should be determined within the range in which displacement of alkaline medium can easily occur. That is to say, it is necessary to choose the consistency range in which the agglomeration of cellulosic materials in the alkaline medium retains its form as if it were a mat or layer, or the like without any gaseous space therein. However, becase pulp fibers have good affinity to water compared with undefibrated cellulosic materials such as wood chips, the consistency of pulp like materials to form the agglomeration of cellulosic materials and alkaline medium as a fiber mat, layer or bed becomes lower than that for wood chips. Thus, the preferable consistency varies according to the cellulosic materials being employed. In general, the consistency of cellulosic materials of between about 5 to about 15% by weight based on the mixture of cellulosic materials and the alkaline aqueous medium is preferred for chemical and semi-chemical grade pulp, and about 10 to about 20% for wood chips.

In the process of the present invention, cellulosic materials are treated at relatively low consistency, so that there is much medium which absorbs generated heat of reaction. The absorbed heat is therefore always carried away together with the medium which is discharged from the reaction vessel continuously throughout delignification by medium displacement. Accordingly, there may be no risk of explosion or overheating in the reaction vessel as in the case of delignification at high pulp consistency.

Alkaline chemicals such as sodium hydroxide, carbonate, and bicarbonate may be used as the alkaline medium in the invention. It is preferred, however, to use sodium carbonate solution, from the recovery point of view, in case of delignification of defibrated materials wherein the rate of alkali penetration into materials is minor factor. On the other hand, sodium hydroxide is well employed on wood chips wherein rapid and effective penetration of alkaline medium into chips is needed.

It is advantageous that the reaction time is remarkably reduced by the process of the present invention, so when the process of the invention is applied in bleaching of chemical pulp, bleaching is accomplished within about 10 minutes, whereas applied in delignification of semi-chemical grade pulp or chip materials, delignification is attained within about 20 to about 40 minutes, which is quite short when compared with processes of prior art. An incidental advantage of the invention is that good quality pulp can be obtained, because the shorter the reaction time required, the less oxidative degradation of cellulosic fiber there is.

As far as reaction temperature is concerned, it may be generally about 80° to 160° C, preferably about 100 to 150° C, depending on the kind of cellulosic materials and the degree of delignification. Partial oxygen-pressure under which oxygen is dissolved in the alkaline aqueous medium previous to the introduction into the reaction vessel maybe at least about 4 kg/cm$^2$, and preferably more than about 7 kg/cm$^2$ when a high degree of delignification is required.

Therefore, the total reaction pressure at the delignification may be required to be more than the partial oxygen pressure which has been previously employed to dissolve oxygen in the alkaline aqueous medium.

In practising the process of the present invention, either continuous or batch system may be employed. FIG. 1 shows a schematic device usable for practising a preferred embodiment of the process of the invention in which delignification is conducted continuously. Defibrated or non-defibrated cellulosic materials are continuously fed into a pressurized reaction vessel 1 from the top thereof. The alkaline aqueous medium in which oxygen has previously been dissolved in an oxygen dissolving tank 2 is also continuously fed into the vessel, which pressure is maintained at the same as or more than the partial oxygen pressure in the oxygen dissolving tank, through a center pipe 3 having a large number of holes or slits arranged lengthwisely on the surface thereof. The alkaline aqueous medium containing dissolved oxygen is then radially spread out from the center pipe, across cellulosic materials fed into the vessel. Thus, the contact of cellulosic materials with the alkaline aqueous medium containing oxygen is performed and dilignification proceeds during such contact. Waste liquor formed during delignification is continuously discharged or extracted through suction pipes 4 and 5, and, at the same time, supplemental fresh alkaline aqueous medium containing dissolved oxygen is continuously charged or fed into the vessel from the tank 2 through the center pipe 3. The consistency of cellulosic materials in the reaction vessel is kept constant by controlling the volume of input medium fed through pipe 3 and output waste liquor extracted through pipes 4, 5. The lignin content of cellulosic materials is reduced by degrees, as cellulosic materials move downwardly in the reaction vessel, and the thus obtained delignified pulp is removed from the bottom of the vessel through a blow valve 6.

Some part of the waste liquor, which is discharged from the relatively early stage of delignification through the upper suction pipe 4, may be transferred to a chemical recovery system (not shown). The alkaline chemical obtained by the recovery system may be fed to the tank 2 for reuse. Another part of the liquor, which is discharged from the latter stage of delignification through the lower suction pipe 5, may be recycled to the tank 2, where the liquor is mixed with the alkaline aqueous solution recovered by the recovery system and, if required, make-up solution and oxygen is thoroughly dissolved under pressure into the mixed solution. The regenerated or retreated solution thus obtained is recharged into the reaction vessel and reused as the supplemental fresh alkaline aqueous medium containing dissolved oxygen.

In this embodiment, two stages of delignification are considered, i.e., the early stage and the latter stage. However, it may be possible in another embodiment to consider more multiple stages or delignification and to assume more multiple layers corresponding to different degrees of delignification of cellulosic materials in the reaction vessel by separately discharging the waste liquor from each of layers in the reaction vessel. By employing such multilayered system as described above, it becomes possible to use different kinds of alkali and different pH values of alkaline aqueous medium at the same time in a single reaction vessel.

For instance, when wood chips are used as cellulosic materials in the process of this invention, it is preferred, in order to obtain good quality of pulp, to treat chips with sodium hydroxide solution of relatively high pH at the relatively early stages or layers in the vessel, and then with sodium carbonate solution of low pH at the latter stages or layers where delignification has proceeded to some extent. Furthermore, it may be possible to carry out both delignification of cellulosic materials and washing of the resultant pulp in one vessel by treating the resultant pulp with hot water instead of the alkaline aqueous solution at the final stage or layer in the vessel. When the liquor extracted from the latter stages of delignification is recirculated, after oxygen is thoroughly dissolved therein, in the relatively early stages in the vessel, the process may be carried out in a counter-current system. By employing such a counter-current system, the total volume of the alkaline aqueous medium in use is made small and the waste liquor having a higher concentration of organic substances is obtained consequently. This is preferable from the chemical recovery point of view.

The following examples are given by way of illustration only.

EXAMPLE 1

Unbleached kraft pulp made from Douglas fir of a Kappa number 32.8 was treated for delignification according to the present invention.

100 g of the pulp was placed in the center of a 8 l autoclave by sandwiching the pulp with two wire mesh plates so as to provide a pulp consistency between two wire mesh plates of about 7% by weight when immersed in an alkaline aqueous medium.

The alkaline solution which contained sodium carbonate and sodium hydroxide ($Na_2CO_3/NaOH=4/1$) and had the alkaline concentration of 5 g/l as sodium oxide, was used as the alkaline medium for cooking.

The alkaline medium in which oxygen had previously been dissolved under a partial oxygen pressure of 8 kg/cm$^2$ was quickly fed into and filled up the autoclave at a temperature of 110° C. Then, into the thus filled-up vessel, fresh alkaline medium containing dissolved oxygen was additionally and continuously pumped from the bottom thereof at the rate of 1 l/minute for 5 minutes, while the overflow surplus liquor was taken out from the top of the vessel. By this procedure, a part of the alkaline cooking medium was continuously displaced during delignification by the fresh alkaline aqueous medium containing dissolved oxygen.

The delignified pulp obtained had Kappa number of 6.8 and brightness of 46.7 (GE).

From the above results, it is evident that the treatment described above is well applied to the first stage of a conventional bleaching process in bleaching kraft pulp.

EXAMPLE 2

Eucalyptus chips were cooked at a temperature of 180° C for 1 hour in an alkaline solution of sodium carbonate at an amount of, as sodium oxide, 15% by weight based on wood, and then were defibrated by a disk refiner. The crude pulp obtained had a Kappa number of 132 in a yield of 68.4%.

The crude pulp was delignified in the same manner and under the same conditions as in Example 1 except for employing the following:

Partial Oxygen Pressure = 12 kg/cm$^2$
Temperature = 140° C
Reaction time = 10 minutes
Magnesium carbonate was additionally mixed in the alkaline cooking medium at the concentration of 0.1 g/l.

For comparison, the same chips were delignified by a conventional kraft process under the following conditions:

Alkali charge = 22% as $Na_2O$ based on woods
Sulphidity = 31.6%
Time to maximum temperature = 70 minutes
Time at maximum temperature = 60 minutes
Wood to liquor ratio = 1:5

The comparative data obtained by the process of the invention and by the kraft process are given in the following Table.

| | Screened Pulp Yield % | Kappa Number | Brightness | Breaking* Length, Km | Burst* Facter | Tear* Factor |
|---|---|---|---|---|---|---|
| Pulp by the process of invention | 47.7 | 7.6 | 50.2 | 6.53 | 5.46 | 116 |
| Kraft Pulp | 42.6 | 10.6 | 29.5 | 5.74 | 5.57 | 115 |

(* PFI mill 400 cc freeness)

As is apparent from the table, the quality of the pulp made by the process of the invention is superior to the kraft pulp in yield and brightness, and equivalent in physical parameters such as breaking length, burst and tear factors.

EXAMPLE 3

Crude pulp having a Kappa number of 126 was prepared from hardwood chips by cooking the chips with sodium carbonate solution and then defibrating the softened chips at the yield of 69.5%.

The thus obtained crude pulp was delignified in the same manner and under the same conditions as in Example 1 except for employing the following:

Partial oxygen pressure = 12 kg/cm$^2$
Temperature = 140° C

The relationship between Kappa number of the thus delignified pulp and reaction time is shown by a curve A in FIG. 2.

As a comparative experiment, delignification was carried out in the same manner and under the same conditions as above-described except for employing an alkaline aqueous medium into which oxygen was not previously dissolved, and blowing oxygen gas directly into the vessel under a partial oxygen pressure of 12 kg/cm$^2$. The relationship obtained is also shown by a curve B in FIG. 2.

From these two curves, it is evidently understood that more than 80% delignification was attained within 5 minutes in case "A" wherein oxygen had previously been dissolved. On the other hand, the same delignification as in "A" was not attained even after 30 minutes in case "B" wherein oxygen gas was put into the vessel directly.

EXAMPLE 4

Shredded Douglas fir chips were cooked at a temperature of 170° C for 30 minutes in an alkaline solution of sodium hydroxide at an amount of, as sodium oxide, 15% by weight based on wood, to thereby obtain undefibrated materials having a Kappa number of 128 in a yield of 62.8%.

The thus prepared undefibrated materials were then delignified in the same manner and under the same conditions as in Example 1 except for employing following:

Consistency of cellulosic materials = 10%
Partial oxygen pressure = 12 kg/cm$^2$
Temperature = 150° C
Alkaline aqueous medium;
at early period of 10 minutes = sodium hydroxide solution
at latter period of 10 minutes = mixture solution of sodium carbonate and hydroxide ($Na_2CO_3$-/NaOH=4/1)

The results obtained were as follows:

Screened pulp yield; 44.2%
Rejects; 0%
Kappa number; 18.2
Brightness; 38.2 (GE)

As can be seen from the above described process and examples, the present invention provides an effective method for rapid delignification of any type of cellulosic materials, such as chemical pulp, semi-chemical grade pulp, and wood chips. It is understood that various changes in the details, arrangements, materials, and process steps which are herein described and illustrated to better explain the nature of the invention may be made by those skilled in the art without departing from the scope of the invention.

What is claimed is;

1. A method of delignifying cellulosic material with oxygen in the presence of an alkaline aqueous medium at an elevated temperature in a pressurized reaction vessel which comprises first dissolving oxygen into a fresh alkaline aqueous medium in an oxygen dissolving tank, and then continuously passing said alkaline medium containing dissolved oxygen through said cellulosic material in said reaction vessel to conduct oxidative delignification of said cellulosic material, continuously discharging a waste liquor formed during delignification from the vessel while continuously charging the fresh alkaline aqueous medium containing dissolved oxygen into the vessel, the consistency of said cellulosic material during delignification being such as to form an agglomeration of the cellulosic material and the alkaline aqueous medium in the form of a layer without any gaseous space therein, such consistency of the cellulosic material being kept substantially constant by controlling the discharging and charging volume of the alkaline aqueous medium, whereby a continuous displacement of the waste liquor with the fresh alkaline aqueous medium containing dissolved oxygen is carried out throughout the course of delignification to thereby eliminate the retardation of the reaction due to a shortage of dissolved oxygen and to remove salts of organic acids by-produced from the interface between the cellulosic material and the alkaline aqueous medium, all of the oxygen which contacts said cellulosic material being introduced into said cellulosic material by said alkaline aqueous medium containing oxygen dissolved therein.

2. The method according to claim 1, wherein said cellulosic material is unbleached chemical pulp.

3. The method according to claim 1, wherein said cellulosic material is semi-chemical grade pulp.

4. The method according to claim 1, wherein said cellulosic material is wood chips.

5. The method according to claim 1, wherein the consistency of said cellulosic material is about 5 to about 15% by weight based on the mixture of the cellulosic materials and the alkaline aqueous medium, and the cellulosic material is unbleached chemical pulp or semi-chemical grade pulp.

6. The method according to claim 1, wherein the consistency of said cellulosic material is about 10 to about 20% by weight based on the mixture of the cellulosic materials and the alkaline aqueous medium, and the cellulosic material is wood chips.

7. The method according to claim 1, wherein the waste liquor discharged from the reaction vessel is treated to recover the alkaline aqueous medium therefrom into which medium oxygen is dissolved and the thus obtained alkaline aqueous medium containing dissolved oxygen is reused for said displacement of waste liquor.

8. The method according to claim 1, wherein said waste liquor is separately discharged from different stages of delignification in the vessel.

9. The method according to claim 1, wherein said waste liquor is separately discharge from different stages of delignification in the vessel, and said fresh alkaline aqueous medium containing dissolved oxygen is also separately charged into different stages of delignification in the vessel.

10. The method according to claim 9, wherein said fresh alkaline aqueous medium separately charged into different stages of delignification is comprised of different types of alkali.

11. The method according to claim 10, wherein said different types of alkali are sodium hydroxide and sodium carbonate, sodium hydroxide being used at a relatively early stage of delignification and sodium carbonate being used at a latter stage of delignification.

12. The method according to claim 9, wherein oxygen is dissolved into the waste liquor discharged from a latter stage of delignification in the vessel, and the thus obtained waste liquor containing dissolved oxygen is charged at a relatively early stage of delignification into the vessel as the fresh alkaline aqueous medium for displacement of the waste liquor.

13. The method according to claim 1 wherein a substantial part of the waste liquor is displaced by fresh alkaline aqueous medium throughout the course of delignification.

* * * * *